US009938857B2

(12) United States Patent
Mayer

(10) Patent No.: US 9,938,857 B2
(45) Date of Patent: Apr. 10, 2018

(54) QUICK CHANGE INSERT

(71) Applicant: Siemens Energy, Inc., Orlando, FL (US)

(72) Inventor: Clinton A. Mayer, Jupiter, FL (US)

(73) Assignee: SIEMENS ENERGY, INC., Orlando, FL (US)

( * ) Notice: Subject to any disclaimer, the term of this patent is extended or adjusted under 35 U.S.C. 154(b) by 889 days.

(21) Appl. No.: 14/460,449

(22) Filed: Aug. 15, 2014

(65) Prior Publication Data

US 2016/0047276 A1 Feb. 18, 2016

(51) Int. Cl.
*F01D 9/02* (2006.01)
*F01D 25/24* (2006.01)

(52) U.S. Cl.
CPC ..... *F01D 25/243* (2013.01); *F01D 9/023* (2013.01)

(58) Field of Classification Search
CPC ..... F01D 9/023; F01D 25/243
USPC ..... 415/241.1
See application file for complete search history.

(56) References Cited

U.S. PATENT DOCUMENTS 1,205,883 A * 11/1916 Gay ..... F16B 35/00 24/100.5
3,862,775 A * 1/1975 Gudmundsen ..... E05B 39/02 292/327
5,154,049 A * 10/1992 Ford ..... F23R 3/48 60/39.37
5,219,256 A * 6/1993 Ford ..... F16B 21/186 411/517
6,152,642 A * 11/2000 Berthold ..... B60T 7/042 24/669
7,204,668 B2 * 4/2007 Le ..... F16B 21/186 411/353
9,328,818 B2 * 5/2016 Coffin ..... F16H 57/0479
9,464,708 B2 * 10/2016 Coffin ..... F16H 57/0479
2004/0062653 A1 * 4/2004 Di Paola ..... F01D 5/323 416/221

* cited by examiner

*Primary Examiner* — Sean J Younger

(57) ABSTRACT

An insert for a component of a gas turbine is provided. The insert includes an insert portion and a retaining element such that the insert portion is retained by the retaining element so that movement of the insert portion relative to the retaining element is prevented. Additionally, a gas turbine component including the insert is provided as well as a method for inserting the insert into a gas turbine component.

17 Claims, 4 Drawing Sheets

QUICK CHANGE INSERT

FIELD

The present application relates to gas turbines, and more particularly to a quick change insert, gas turbine component and a method for inserting the insert into a gas turbine component.

BACKGROUND

Threaded inserts are typically used to secure a transition piece onto the Turbine Vane Carrier of a gas turbine. Generally the transition aft support bracket includes two holes through which a threaded insert is inserted into a corresponding threaded hole in the turbine vane carrier. Typical inserts used are threaded wire helical inserts or externally threaded key locking inserts such as Keenserts®. Inserts of this type are readily available, however, removal and replacement of the inserts can be time consuming having an adverse effect on the outage time of the gas turbine. Keenserts® require machining to clear the damaged threads from a previous threaded insert, creating a new thread, and screwing the insert into the threaded hole in a component. Other threaded inserts include the Helicoil®. The Helicoil® also requires machining to remove damaged threads from previous threaded inserts within the component.

SUMMARY

Briefly, aspects of the present disclosure relate to an insert for a component of a gas turbine, a gas turbine component arranged coaxially about a turbine rotor, and a method for inserting an insert into a gas turbine component.

In one aspect, there is provided an insert for a component of a gas turbine, the insert includes an insert portion and a retaining element arranged to retain the insert portion. The insert portion is retained by the retaining element so that movement of the insert portion relative to the retaining element is prevented.

In another aspect, a gas turbine component arranged coaxially about a turbine rotor is provided. The gas turbine component arranged coaxially about a turbine rotor includes an insert portion, a component including a body and a cavity arranged within a face of the component body configured to receive the insert portion, and a retaining element. The insert portion is retained by the retaining element so that rotational and axial movement of the insert portion relative to the retaining element is prevented.

In another aspect, there is provided a method for inserting an insert into a gas turbine component. The method includes pushing an insert portion into a hole in a face of a component and securing the insert portion by insertion of a retaining element. The retaining element prevents the insert portion from movement.

DETAILED DESCRIPTION

Components of gas turbines include portions where the component is machined in order to accept an insert. The insert is used in order to attach additional components to the gas turbine component, such as a transition component, and/or to fill in a hole in the component to prevent and/or control leakage of a fluid. During refurbishment and/or service of the gas turbine, the inserts may require removal and/or replacement. A quick change insert provided allows the insert to be removed and replaced quickly. In an embodiment of the quick change insert for a component of a gas turbine two elements are provided, an insert portion, and a retaining element portion. A method for inserting an insert into a gas turbine component is also provided. The method provides a means for quickly swapping out inserts, by changing the way the insert is affixed, as compared to changing threaded inserts. As long as there is sufficient surrounding material for the machined features to accept the insert portion and the retaining element, the threaded features already in an existing gas turbine can be eliminated. Typically, the machined features consume more of the component material as the existing threaded features need to be machined out. The time saved swapping out inserts using the method ultimately reduces outage time of the gas turbine which is extremely valuable to the owner or operator of the gas turbine.

Figure 1:
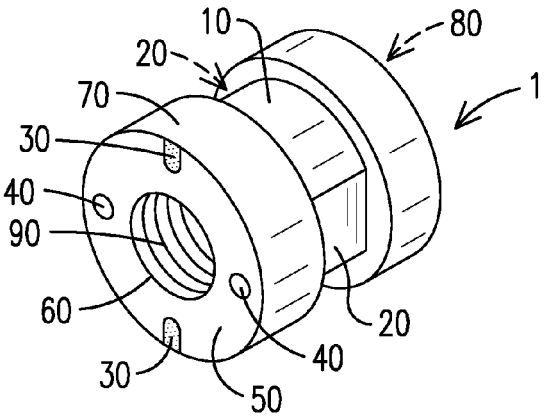
FIG. 1 illustrates a perspective view of an embodiment of an insert portion.

As illustrated in FIG. 1, an insert portion (1) is shown. The insert portion (1) may be inserted into a cavity within a component to provide an attachment means for the component. The insert exhibits an outer surface (70) adapted to mate with the cavity. The outer surface (70) may include any shape that mates with the inner surface of the cavity. For example, the outer surface (70) may have any geometric surface such as rectangular, triangular, or free form, or a cylindrical surface. The shape of the geometric surface may provide a securing means which would prevent a movement of the insert. For example, rectangular, triangular or free form shape surfaces would provide a securing by preventing a rotational movement when inserted into the mating cavity within the component. A cylindrical surface, which is easy to manufacture and easy to insert, would not provide said securing means.

The insert may include an outward face (50) and an inward face (80). The outward face (50) faces outward from the cavity. The outward face (50) may be flush with the outer surface of the component, recessed from the outer surface of the component or protrude from the outer surface of the component. The inward face (80) may be a planar wall as in the illustrated embodiment, however, other shapes could also be envisioned such as a connic shape or triangular shape that will fit into a corresponding recess portion of the cavity. A securing means, which may prevent a movement of the insert portion, may be achieved by the shape of the inward face (80) when inserted into the recess portion. For example, if a triangular inward face is mated to a triangular recess portion, rotational movement is prevented. In the illustrated embodiment, the outward face (50) of the insert portion (1) and the outer surface (50) of the component are each embodied as a planar wall.

A retention area (10) may be included in the insert portion to provide a means to engage a retaining element. The retention area (10) mates with a retention area of a retention element in order to prevent a movement of the insert portion thereby providing a securing means. The retention area may include one or more engagement features such as a recess, which is also considered a groove, within the outer surface (70) or a wall. The wall may have a planar portion. In the illustrated embodiment shown in FIG. 1, the insert portion includes the retention area embodied as a groove (10), which is circumferential, and two side walls (20) which are planar. While the embodiment of FIG. 1 shows the two side walls as parallel, this is for illustrative purposes only. The side walls may be angled such that they are not parallel.

The insert portion (1) may include an internal thread (90) with which a fastener may be attached. For example, the fastener may be a bolt or a screw. The fastener may be used as the attachment means to attach a further component to the component. An opening (60) for the internal thread (90) may begin from the outward face (50) and may continue at least a portion of the length of the insert portion (1) from the opening (60) to the inward face (80). The internal thread (90) of the insert portion may contain a self-locking feature such as deformed threads, nylon insert, etc, such that the insert portion requires replacement at each disassembly/assembly interval of the component. In another embodiment, a stud protrudes from the outward face (50) of the insert portion (1). The stud (95) may be threaded in order to accommodate a nut as shown in FIG. 2.

An assembly tooling interface feature (40), in which a tool for inserting may be attached, may be included on an outward face (50) of the insert portion. For example, the assembly tooling interface feature (40) may be embodied as a recess in which the tool may be inserted. While two recesses are shown for illustrative purposes only, to one skilled in the art it would be clear that one recess or more than two recesses may be used. Furthermore, one skilled in the art would understand that the assembly tooling interface may be embodied as protrusions or combinations of recesses and protrusions.

The insert portion (1) may need to be aligned in relation to the component. An embodiment of the insert portion includes an alignment mark (30) disposed on the outward face (50) of the insert portion to denote a position of the insert portion (1). The alignment mark (30) may be embodied as a mark on the outward face (50) which would be aligned with a corresponding mark on the component. The mark may be for example painted, engraved, stamped or etched.

Figure 2:
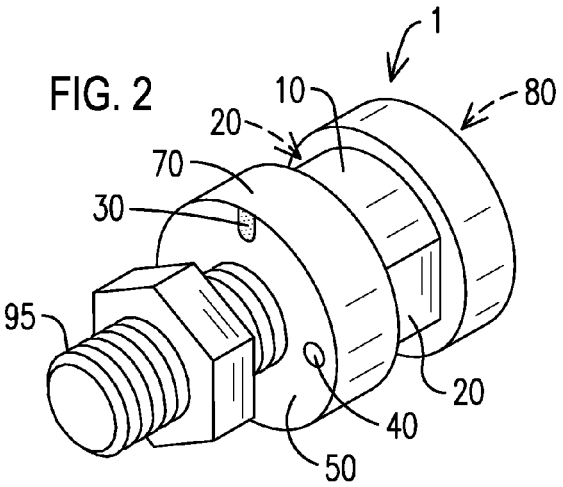
FIG. 2 illustrates a perspective view of another embodiment of an insert portion.
Figure 3:
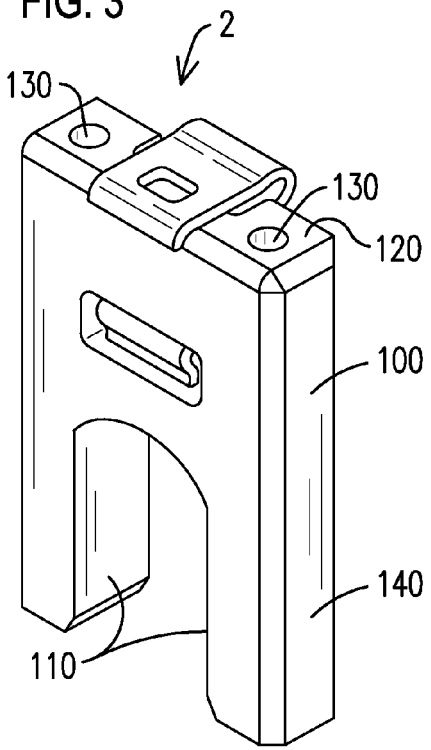
FIG. 3 illustrates a perspective view of an embodiment of a retaining element.

FIG. 3 shows a retaining element (2) that corresponds to the insert portion (1) described in the embodiments shown in FIGS. 1 and 2. The retaining element (2) is positioned in the component to retain the insert portion (1) to prevent a movement of the insert portion (1), thereby providing a securing means. The securing means of the retaining element may be facilitated by one or more features of the retaining element.

The retaining element (2) includes an outer surface (100) that mates with a slot within the component. The slot opens outward from the component. Any shape may be used that mates with the inner surface of the slot of the component.

The retaining element (2) may include an inner surface (110) which mates with the retention area (10) of the insert portion (1) in order to prevent a movement of the insert portion (10). Thereby, the mating provides a securing means. The inner surface (110) may include one or more features such as an arc section and/or a wall. The wall may have a planar portion. When more than one wall is present they may be parallel.

While other shapes may be envisioned, the illustrated retaining element (2) is in the shape of a retention fork. On the outer surface, the illustrated retention fork includes outer side walls (140), which may be planar and which may be parallel to one another. The illustrated inner side walls of the retention fork includes parallel planar side walls (110) that correspond to the planar side walls (20) of the insert portion (1), as embodied in FIG. 1, such that each planar side wall of the insert portion (20) abuts the corresponding the planar side wall (110) of the retention element (2). While the illustrated side walls (110) are parallel, this is for illustration purposes only and not limiting. At least one side wall (110) may be angled.

An outward face (120) of the retention element facing outward from the cavity may also be planar. The planar outward face may be flush, protruding, or recessed with the component's outer surface. In the illustrated embodiment, the outward face (120) is the top face of the retention fork.

In an embodiment, the retaining element (2) may include at least one pin which fits within the insert portion to provide a securing means. In this embodiment, the insert portion (10) would include a corresponding recess for each pin in which the retaining element fits. It would be understood that a plurality of pins may be used as a securing means. When a plurality of pins are used, at least two of the plurality of pins may be connected together.

The outward face (120) of the retaining element (2) may include an assembly tooling interface feature (130) in which a tool may be inserted for insertion and/or removal of the retention element. In the illustrated embodiment, the assembly tooling interface feature (130) is embodied as recesses included in the top face (120) of the retention element. One skilled in the art would appreciate that the number of recesses may be more or less than illustrated. Furthermore, one skilled in the art would understand that the assembly tooling interface feature (130) may be formed as protrusions or combination of recesses and protrusions.

Figure 4:
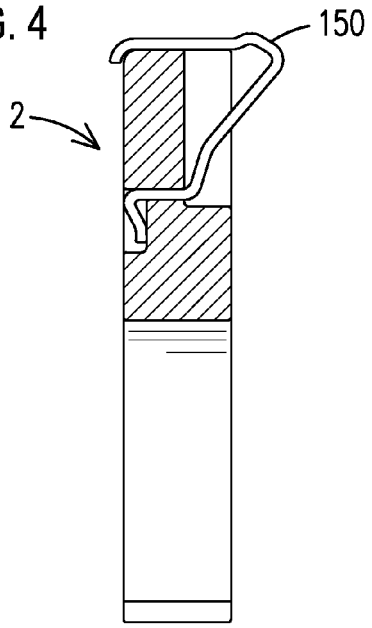
FIG. 4 illustrates a side view of the retaining element of FIG. 3.

The retaining element (2) may also include a radial retention mechanism (150) which holds the retaining element (2) in place in the cavity of the component. Thereby the radial retention mechanism (150) acts as a securing means. FIG. 4 shows a side view of the retention fork (2) with the radial retention mechanism embodied as a retention clip (150). The illustrated embodiment of the retention clip is a flat wire-like element with one end disposed flat on the top face of the retention element (2), protrudes past the retaining element and curves down and back into the interior of the element. The outer protruding portion loops out and above forming a clip. This clip portion fits into a corresponding pocket in the cavity of the component. In addition to the clip or in lieu of the clip the radial retention mechanism may include but is not limited to a set screw or a press fit pin.

A method for inserting an insert into a gas turbine component is described by way of FIGS. 5-9. The insert portion (1) may be pushed into an opening (230) in a face of the gas turbine component (3) and secured by one or more securing means. Each securing means prevents a movement of the insert. A movement may include a rotational movement, an axial movement along the axis of the insert portion or both rotational and axial movements.

The insert portion (1) may be secured by the insertion of a retaining element (2) within the component (3). The retaining element prevents the insert portion from movement along the axial (250) and rotational axes (260).

Figure 5:
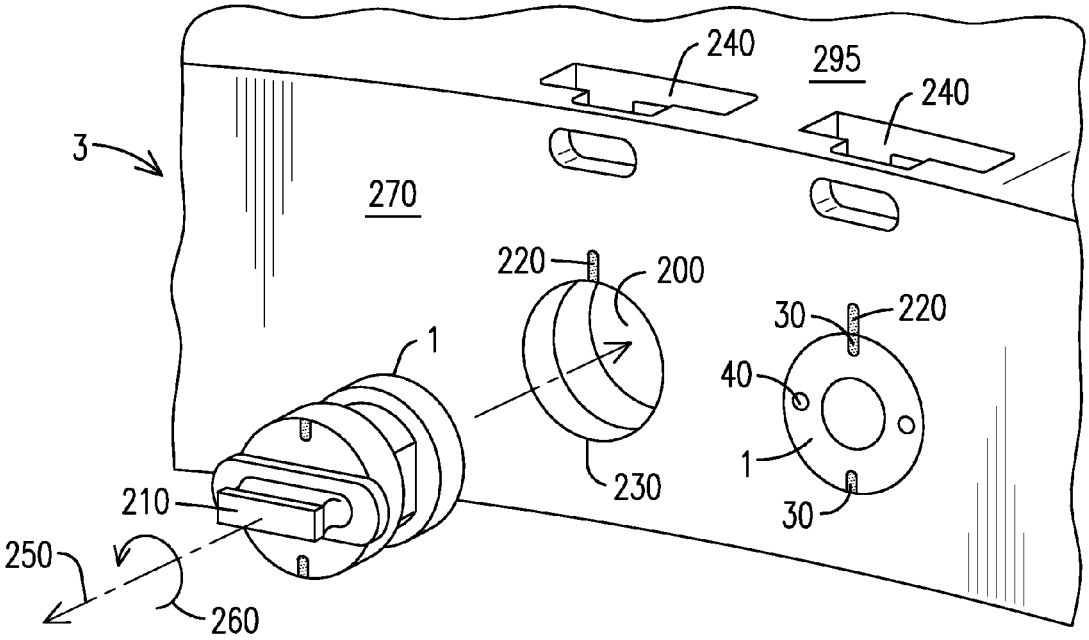
FIG. 5 illustrates a cross section of an embodiment of features in a gas turbine component.

The insert portion (1) is pushed into the opening (230) of the cavity (200) on the front face (270) of the component as shown in FIG. 5. The gas turbine component (3) includes a body and the cavity (200) arranged within a face of the component body configured to receive both the insert portion (1) and the retaining element. An insert assembly tool (210) may be attached to the assembly tooling interface feature (40) of the insert portion (1) to enable the installation of the insert portion into the cavity of the gas turbine component. Thereby the pushing of the insert portion (1) may be done by way of the insert assembly tool (210). In another embodiment the insert portion is manually pushed into the cavity without an insert assembly tool (210).

The cavity (200) is formed within the gas turbine component (3). The cavity may be formed by machining and/or casting. The machining may be done mechanically, electrically, and/or chemically.

In an embodiment of the method, the gas turbine component (3) is machined to form the opening (230) in the cavity (200) to accommodate the insert portion (1) prior to the pushing of the insert. Likewise, the gas turbine component (3) may be machined to form the slot (240) to accommodate the retaining element (2) prior to the inserting of the retaining element (2).

In an embodiment of the method, the gas turbine component (3) is manufactured with the slot (240) in the cavity (200) to accommodate the retaining element (2) prior to the inserting of the retaining element (2). Optionally, the cavity includes a pocket (290) to accommodate the retention clip (150). Likewise, the gas turbine component (3) may be manufactured with the opening (230) in the cavity to accommodate the insert portion (1) prior to inserting the insert portion (1).

The insert portion (1) may need to be aligned. In this case, the insert portion is adjusted so that the alignment marks (30) on the insert portion (3) line up with alignment marks (220) on the component. Similarly to the alignment mark of the insert portion, the alignment mark (220) on an outer face of the component may be painted, engraved, stamped, or etched. In the illustrated embodiment shown in FIG. 5, one alignment mark (30) of the insert portion denotes a topmost point of the insert portion and the other alignment mark of the insert portion denotes the bottommost point of the insert portion (1) which are used so that the insert portion may be positioned correctly, with the topmost point at the top and the bottommost point pointing down, before being retained by the retaining element (2). The location and number of alignment marks are for example and not meant to be limiting.

Figure 6:
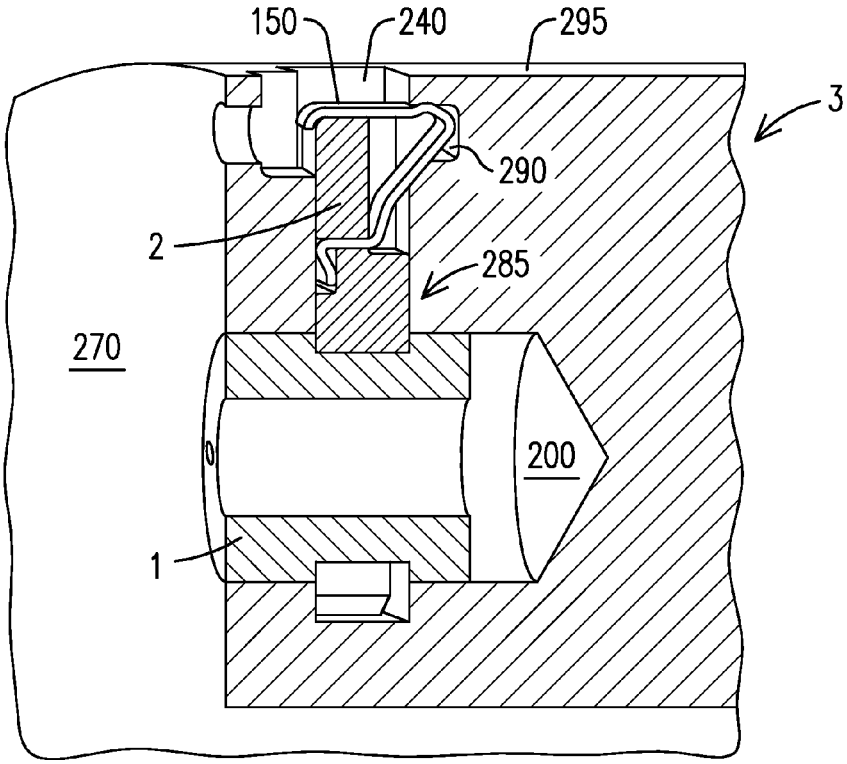
FIG. 6 illustrates a perspective view of an embodiment of portion of a turbine vane carrier with an embodiment of an insert portion and an embodiment of a retaining element.

A radial retention mechanism (150) is used to secure the retaining element (2) radially within the cavity (200). As illustrated in FIG. 6, the retention clip (150) of the embodiment shown in FIG. 4 snaps into a pocket (290) within the cavity (200) of the gas turbine component (3). The retaining element (2) prevents axial and rotational movement of the insert portion (1) relative to the gas turbine component (3). The insert portion (1) is rotationally constrained by the abutting of the planar side walls (20) of the insert portion against the planar side walls of the retaining element (2) once installed in the component (3). In the component (3), the insert is axially constrained through an interface of the retention fork to the component along with the fit of the retention fork into the retention groove (10) on the insert portion (1). The radial constraint comes from the interface of the retention fork to the cavity (200) in the component (3).

Figure 7:
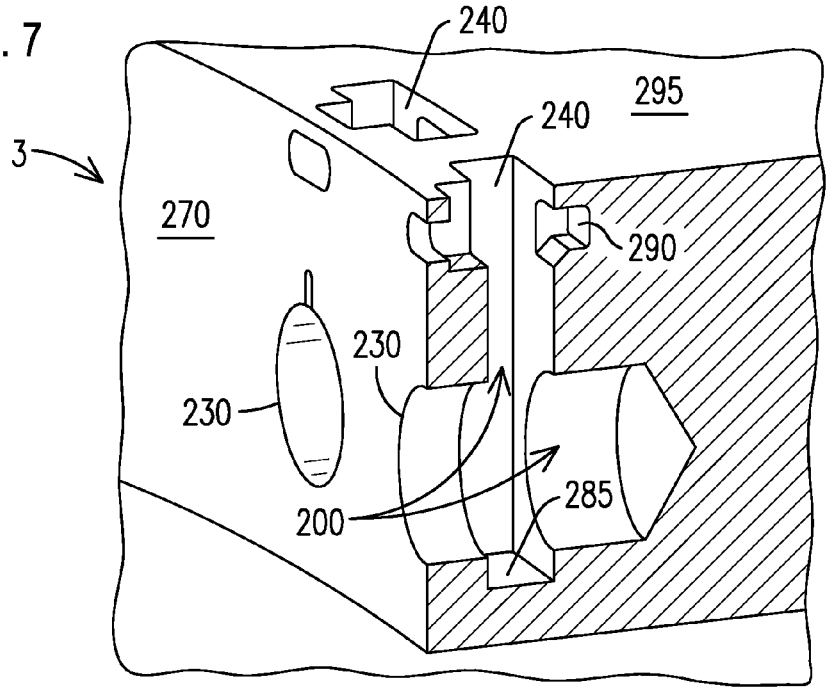
FIG. 7 illustrates a perspective view of an embodiment of portion of a turbine vane carrier.

A side view of the cavity (200) for an embodiment is shown in FIG. 7. For the embodiment shown in FIG. 7, the opening (230) of the cavity (200) is arranged in a front face (270) of the component to accept the insert portion (1). An opening of the slot (240) is arranged in a top face (295) of the component to accept the retention element (2). For example the cavity (200) does not include any threaded features. An embodiment of the insert (285) with the retaining element (2) mated to the insert portion (1) is shown. In this illustrated embodiment, the contour of the retaining element mated to the insert portion corresponds to the internal contour of the cavity (200).

Figure 8:
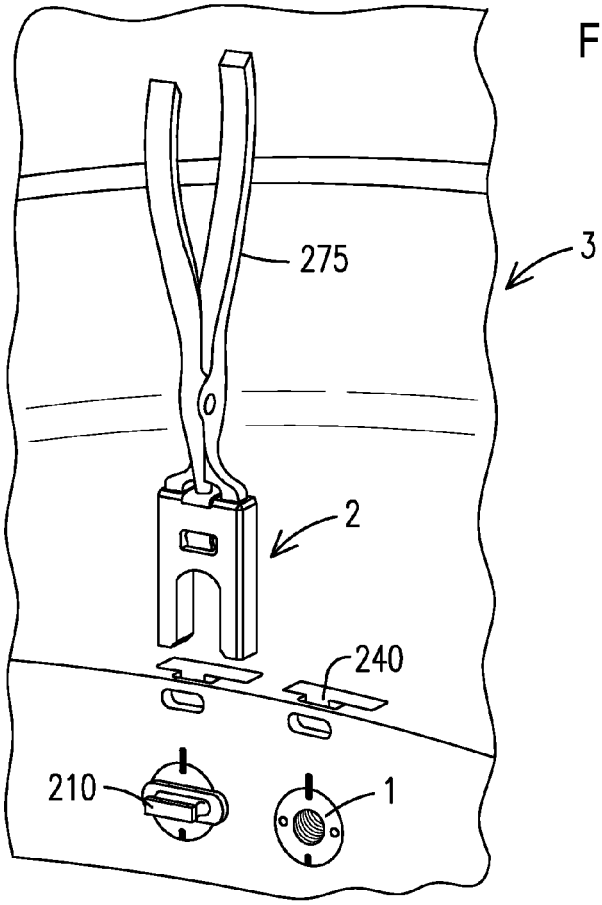
FIG. 8 illustrates a perspective view of an embodiment of a retaining element assembly tool attached to an embodiment of a retaining element.
Figure 9:
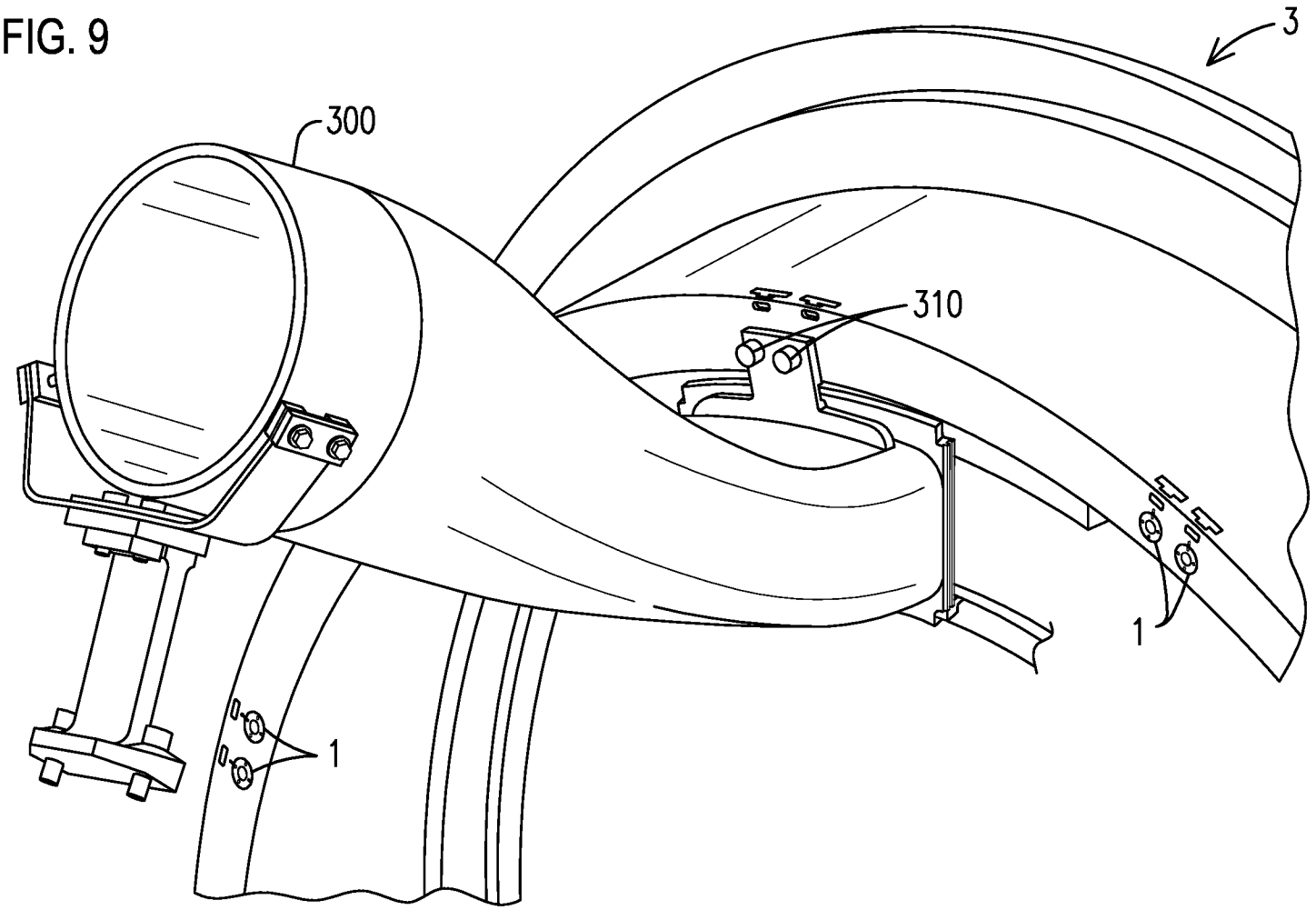
FIG. 9 illustrates a perspective view of a transition element attached to a turbine vane carrier according to an embodiment.

In an embodiment of FIG. 8, the retaining clip (150) is used as the radial retention mechanism. Thereby the radial retention mechanism (150) acts as a securing means. The retaining clip (150) of the retaining element is compressed using the retention element assembly tool (275) and inserted into the slot (240) until the retaining clip (150) snaps into a pocket (290) in the cavity (200) of the component (3) as shown in FIG. 6. In another embodiment, the retaining element (2) may be pushed into the slot (240) manually without using the retention element assembly tool (275).

A gas turbine component (3) may accommodate the insert in order to attach the gas turbine component to a further gas turbine component. In certain embodiments where interfacing components, such as a transition element (300) of a gas turbine shown in FIG. 9, need to be attached to the gas turbine component (3), which in this embodiment is a turbine vane carrier (3), fasteners (310) are affixed to the interfacing component by attachment of the fastener into the opening (60) of the insert portion. The fastener may then be torqued to secure the interfacing element to the component. In another embodiment, fasteners such as the stud (95) and nut, shown in FIG. 2, may be used to attach the further gas turbine component (300)

In order to remove the insert, the method may be done in the reverse order. The retention element assembly tool (275) may be needed for removal of the retaining element (2).

While specific embodiments have been described in detail, those of ordinary skill in the art will appreciate that various modifications and alternative to those details could be developed in light of the overall teachings of the disclosure. For example, elements described in association with different embodiments may be combined. Accordingly, the particular arrangements disclosed are meant to be illustrative only and should not be construed as limiting the scope of the claims or disclosure, which are to be given the full breadth of the appended claims, and any and all equivalents thereof. It should be noted that the term "include" and "comprising" as well as derivatives thereof, mean inclusion without limitation; the use of articles "a" or "an" does not exclude a plurality, and the term "multiple" refers to "a plurality of", i.e., more than one.

What is claimed:

1. An insert for a component of a gas turbine, comprising:

an insert portion including a retention groove including a planar side wall; and a retaining element arranged to retain the insert portion, wherein the insert portion is retained by the retaining element so that movement of the insert portion relative to the retaining element is prevented, wherein the retaining element includes a planar side wall that corresponds to the planar side wall of the insert portion, and wherein the insert portion includes a shape of a cylinder which includes a circumferential retention groove.

2. The insert as claimed in claim 1, further comprising an assembly tooling interface feature disposed on an outward face of the insert portion for attaching an assembly tool.

3. The insert as claimed in claim 1, further comprising at least one alignment mark disposed on an outward face of the insert portion.

4. The insert as claimed in claim 1, wherein the retaining element includes a shape of a fork wherein the internal and external sides of the fork include planar walls.

5. The insert as claimed in claim 1, wherein the retaining element includes a retention clip with a spring.

6. The insert as claimed in claim 1, wherein the insert portion includes an internal thread.

7. The insert as claimed in claim 1, wherein the insert portion includes an internal stud which protrudes from an outer face of the insert portion.

8. A gas turbine component arranged coaxially about a turbine rotor, comprising:

an insert portion including a retention groove including a planar side wall;

a component including a body and a cavity arranged within a face of the component body configured to receive the insert portion; and a retaining element, wherein the insert portion is retained by the retaining element so that rotational and axial movement of the insert portion relative to the retaining element is prevented, wherein the retaining element includes a planar side wall that corresponds to the planar side wall of the insert portion, and wherein the insert portion includes a shape of a cylinder which includes a circumferential retention groove.

9. The gas turbine component as claimed in claim 8, wherein an internal thread of the insert portion is deformable such that the insert portion is replaced at each disassembly/assembly interval.

10. The gas turbine component as claimed in claim 8, wherein a first alignment mark disposed on an outward face of the insert portion is aligned with a second alignment mark on the gas turbine component to correctly align the insert portion within the gas turbine component.

11. A method for inserting an insert into a gas turbine component, comprising:

pushing an insert portion into a hole in a face of the gas turbine component; and securing the insert portion by inserting a retaining element; and wherein the retaining element prevents the insert portion from movement, wherein the insert portion includes a retention groove including a planar side wall, wherein the insert portion includes a shape of a cylinder which includes a circumferential retention groove, and wherein the retaining element includes a planar side wall that corresponds to the planar side wall of the insert portion.

12. The method as claimed in claim 11, wherein the pushing further comprises:

attaching an insert assembly tool to the insert portion, and aligning the insert portion until a first alignment mark on the insert portion is aligned with a second alignment mark on the component.

13. The method as claimed in claim 11, wherein the inserting the retaining element further comprises attaching a retention element assembly tool to the retention element.

14. The method as claimed in claim 11, wherein an assembly tool compresses a retaining clip of the retaining element.

15. The method as claimed in claim 11, further comprising torqueing a threaded fastener into an internal threaded portion of the insert portion in order to attach an interfacing component to the component.

16. The method as claimed in claim 11, wherein the retaining element is inserted into a slot until a retaining clip fits into a corresponding pocket in the component.

17. The method as claimed in claim 15, further comprising:

inserting the retaining element into a slot in the component, wherein a first planar side wall of the retaining element abuts a second planar side wall of the threaded insert.

* * * * *